US009409220B2

(12) United States Patent
Henniger et al.

(10) Patent No.: US 9,409,220 B2
(45) Date of Patent: Aug. 9, 2016

(54) EXERCISE EQUIPMENT, CONNECTOR OR ANCHOR, AND METHOD OF MAKING SAME

(71) Applicants: William Henniger, Columbus, OH (US); Ian MacClean, Columbus, OH (US)

(72) Inventors: William Henniger, Columbus, OH (US); Ian MacClean, Columbus, OH (US)

(73) Assignee: COULTER VENTURES, LLC, Columbus, OH (US)

( * ) Notice: Subject to any disclaimer, the term of this patent is extended or adjusted under 35 U.S.C. 154(b) by 0 days.

(21) Appl. No.: 14/065,672

(22) Filed: Oct. 29, 2013

(65) Prior Publication Data

US 2014/0119811 A1 May 1, 2014

Related U.S. Application Data

(60) Provisional application No. 61/721,306, filed on Nov. 1, 2012.

(51) Int. Cl.

| | |
|---|---|
| ***B21D 5/16*** | (2006.01) |
| ***F16B 9/02*** | (2006.01) |
| ***B21D 53/36*** | (2006.01) |
| *E04B 1/19* | (2006.01) |

(52) U.S. Cl.

CPC *B21D 5/16* (2013.01); *B21D 53/36* (2013.01); *F16B 9/026* (2013.01); *E04B 2001/1918* (2013.01); *E04B 2001/1963* (2013.01); *Y10T 403/39* (2015.01)

(58) Field of Classification Search

CPC ..... B21D 5/16; E04B 2001/1918; E04B 2001/1963; E04B 2001/2406; E04B 2001/405; E04F 11/1812; E04F 11/1814; F16B 9/02; F16B 9/026; F16B 12/42

USPC ..... 403/187, 190, 192, 199, 262

See application file for complete search history.

(56) References Cited

U.S. PATENT DOCUMENTS

| | | | | |
|---|---|---|---|---|
| 1,214,738 | A * | 2/1917 | Wolf | 403/187 |
| 1,945,925 | A * | 2/1934 | Stiefel | E04B 1/2608 403/2 |
| 2,990,590 | A * | 7/1961 | Graveley | E04F 10/08 403/189 |
| 4,611,948 | A * | 9/1986 | Johnson | B60P 3/1033 403/187 |
| 5,186,571 | A * | 2/1993 | Hentzschel | 403/231 |
| 6,209,268 | B1 * | 4/2001 | Schmidt | E04B 1/2608 52/665 |
| 8,833,030 | B2 * | 9/2014 | Zimmerman | E04B 1/2608 248/300 |
| 8,834,057 | B2 * | 9/2014 | Adams, Jr. | 403/233 |
| 8,839,588 | B2 * | 9/2014 | Philbin | E04B 1/38 52/704 |
| 2011/0107710 | A1 * | 5/2011 | Sias | 52/655.1 |
| 2013/0065738 | A1 * | 3/2013 | Henniger | A63B 21/0724 482/104 |

FOREIGN PATENT DOCUMENTS

| | | | |
|---|---|---|---|
| GB | 2487239 | * | 7/2012 |

* cited by examiner

*Primary Examiner* — Josh Skroupa

(74) *Attorney, Agent, or Firm* — Vorys, Sater, Seymour and Pease LLP; William L. Klima

(57) ABSTRACT

An exercise equipment connector and exercise equipment. Also provided is a method of making an exercise equipment connector.

30 Claims, 2 Drawing Sheets

EXERCISE EQUIPMENT, CONNECTOR OR ANCHOR, AND METHOD OF MAKING SAME

FIELD

An exercise equipment, exercise equipment connector, and method of making same.

BACKGROUND

Exercise equipment can be free standing; however, it is desirable to be able to secure exercise equipment to a support such as the floor, wall, ceiling, or other exercise equipment for performance and safety reasons. For example, exercise equipment can move and/or tip over during use, and proper anchoring is essential for performance and safety.

There exists a need for anchoring exercise equipment quickly and effectively. Further, it is desirable that such connector is sufficiently strong and durable during long term use and operation of the exercise equipment, and properly anchor same.

SUMMARY

An improved exercise equipment.

An improved exercise equipment anchor.

An improved exercise equipment connector.

An exercise equipment comprising or consisting of a member connected to connector or anchor.

An exercise equipment comprising or consisting of a vertical member connected to a connector or anchor.

An exercise equipment comprising or consisting of a vertical member connected to a three-sided connector or anchor.

An exercise equipment comprising or consisting of a vertical member connected to a three-sided connector or anchor comprising three finger connector portions bent outwardly from each side of the three-sided connector.

An exercise equipment anchor or connector comprising or consisting of a channel and at least finger connector portion.

An exercise equipment anchor or connector comprising or consisting of a three-sided channel and three finger connector portions.

An exercise equipment anchor or connector comprising or consisting of a three-sided channel and three finger connector portions each, respectively, extending outwardly from a side of the three-sided channel.

An exercise equipment anchor or connector comprising or consisting of a three-sided channel and three finger connector portions each, respectively, extending outwardly from a side of the three-sided channel at one end of the three-sided channel.

An exercise equipment anchor or connector comprising or consisting of a three-sided channel and three finger connector portions each, respectively, bent outwardly from a side of the three-sided channel at one end of the three-sided channel.

A method of making an exercising equipment anchor or connector, comprising or consisting of providing a flat metal sheet, and bending the flat metal sheet two times to create three-sided channel.

A method of making an exercising equipment anchor or connector, comprising or consisting of providing a flat metal sheet, and bending the flat metal sheet two times to create three-sided channel comprising three side portions connected together along bends in the three-side channel.

A method of making an exercising equipment anchor or connector, comprising or consisting of providing a flat metal sheet, bending the flat sheet two times to create a three-side channel comprising three side portions connected together along bends in the three-side channel.

A method of making an exercising equipment anchor or connector, comprising or consisting of providing a flat metal sheet, bending the flat sheet at two locations to create a three-side channel comprising three side portions connected together along bends in the three-side channel.

A method of making an exercising equipment anchor or connector, comprising or consisting of providing a flat metal sheet, bending the flat metal sheet two times to create three channel side portions connected together at the bends, and bending at least one side flange portion from the flat metal sheet.

A method of making an exercising equipment anchor or connector, comprising or consisting of providing a flat metal sheet, bending the flat metal sheet at a first location and a second location to create three channel side portions connected together at the bends, and bending the flat metal sheet at a third location to create at least one side flange connector portion from the flat metal sheet.

A method of making an exercising equipment anchor or connector, comprising or consisting of providing a flat metal sheet, bending the flat metal sheet two times to create three channel side portions connected together at the bends, and bending the three channel side portions to create three side flange connect portions so that each side flange connector portion is bent outwardly from each channel side portion.

A method of making an exercising equipment anchor or connector, comprising or consisting of providing a flat metal sheet, stamping the flat metal sheet to create a flat metal blank, and bending the flat metal blank to create the anchor or connector.

A method of making an exercising equipment anchor or connector, comprising or consisting of providing a flat metal sheet, stamping the flat metal sheet to create a flat metal blank, and bending the flat metal blank at multiple locations to create the anchor or connector.

A method of making an exercising equipment anchor or connector, comprising or consisting of providing a flat metal sheet, stamping the flat metal sheet to create a flat metal blank, and simultaneously bending the flat metal blank at multiple locations to create the anchor or connector.

A method of making an exercising equipment anchor or connector, comprising or consisting of providing a flat metal sheet, stamping the flat metal sheet to create a flat metal blank, and bending the flat metal blank at multiple locations in a particular sequence to create the anchor or connector.

A method of making an exercising equipment anchor or connector, comprising or consisting of providing a flat metal sheet, stamping the flat metal sheet to create a flat metal blank comprising a main blank portion and at least one finger blank portion, and bending the flat metal blank at multiple locations to create the anchor or connector.

A method of making an exercising equipment anchor or connector, comprising or consisting of providing a flat metal sheet, stamping the flat metal sheet to create a flat metal blank comprising a main blank portion and three finger blank portions, and bending the flat metal blank at multiple locations to create the anchor or connector.

A method of making an exercising equipment anchor or connector, comprising or consisting of providing a flat metal sheet, stamping the flat metal sheet to create a flat metal blank comprising a main blank portion and three finger blank portions positioned side-by side at one end of the main blank portion, and bending the flat metal blank at multiple locations to create the anchor or connector.

BRIEF DRAWINGS

DETAILED DESCRIPTION

Figure 1:
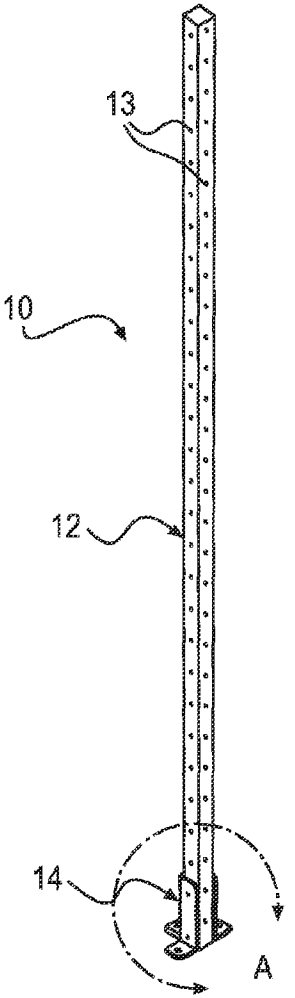
FIG. 1 is a perspective view of an exercise equipment.

A exercise equipment 10 is shown in FIG. 1. The exercise equipment 10 comprises a member 12 (e.g. vertical member) and a connector 14 (e.g. anchor). The connector 14 is shown connecting the member 12 to a floor F (FIG. 2); however, the connector 14 can be used to connect the member 12 to a wall, ceiling, support, member, beam, and/or to another piece of exercise equipment.

The member 12 is provided with through holes 13 along the entire length of the member 12. The holes extend through both sets of opposed sides of the member 12 to allow connection with the connector 14 at different heights and different perpendicular orientations relative to a longitudinal axis of the member 12. This allows multiple members 12 to be connected together to make up a rack arrangement (e.g. four (4) members 12 connected together in a square or rectangular arrangement when viewing from top of rack).

Figure 2:
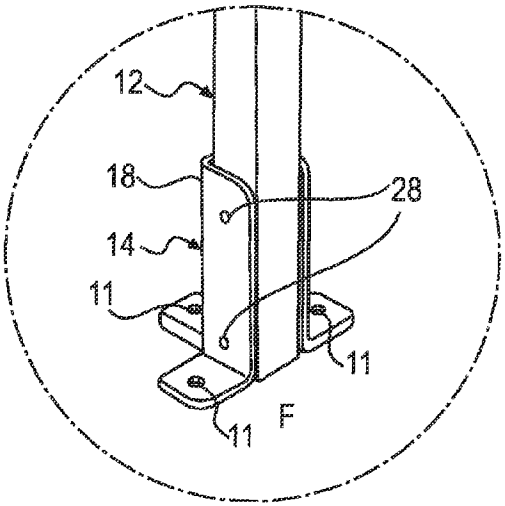
FIG. 2 is an enlarged perspective view of the exercise equipment shown in FIG. 1.

The connector 14 can be connected to the floor F by bolt anchors 11, as shown in FIG. 2 to prevent movement of the member 12 relative to the floor F. This can be done, for example, in the final installation of exercise equipment in a gym.

Figure 3:
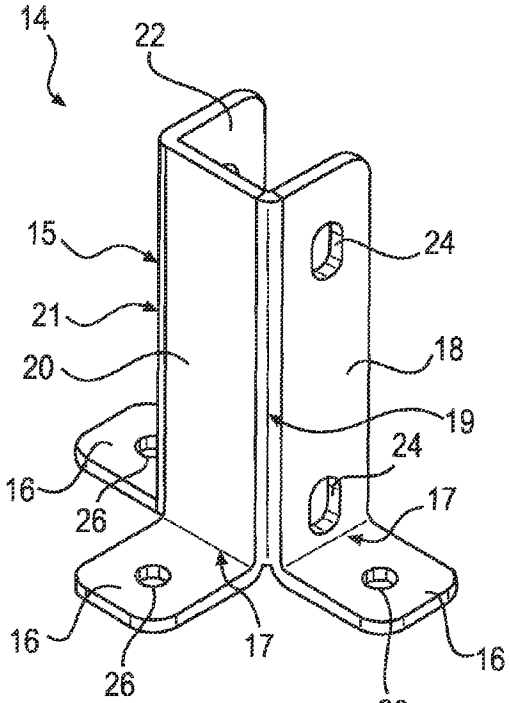
FIG. 3 is a perspective view of a connector or anchor of the exercise equipment shown in FIG. 1.

The connector 14 by itself is shown in FIG. 3 as a three-sided connector 14 having one open side and three closed sides. The open side facilitates assembly with the member 12. Specifically, the open side of the connector 14 allows for an end of the member 12 to be moved laterally into the connector 14 for assembly.

The connector (e.g. anchor) can also be two-sided (e.g. adjacent or opposed sides) or four-sided (e.g. four sides with an open seam provided by bending the metal plate three times, or four sides with a closed seam, for example, by welding the seam closed after bending to enhance the strength of the connector). In a two sided connector (i.e. two adjacent sides removed, or two opposed sides removed), for example, a flat metal plate is bent into a channel with two sides being mostly removed along a length of the channel. A metal blank must be initially formed (e.g. by stamping a metal sheet) so that when bent a channel portion is provided at one end of the connector so that the two remaining sides are still connected together by the channel portion after the connector is created.

The connector 14 comprises three (3) flanges 16, 16, 16 extending outwardly from the connector 14. The flanges 16, 16, 16 are shown perpendicular (i.e. 90°) relative to the center vertical axis of the connector 14; however, the flanges 16, 16, 16 can be set at a different angle from that shown (e.g. 0° to 180° relative to the plane of each side channel portions 18, 20, 22). Further, the flanges 16, 16, 16 can be set at the same angle or different angles.

The opposed side channel portions 18 and 22 are each provided with a set of spaced apart through holes 24, 24, to allow connection with the member 12, for example, by a set of bolts 28, 28 (FIG. 2) having a set of locking nuts (not shown). The flanges 16, 16, 16 are each provided with a through hole 26 (FIG. 3) for securing the connector 14 to the floor F, for example, with a set of bolt anchors 11 (FIG. 2). The through holes 26 can be elongated shaped, as shown in FIG. 3.

The connector 14 can be made by a variety of methods using a variety of materials. For example, the method can include one or more steps of forming, bending, welding, machining, molding, injection molding, insert molding, or a combination thereof. Further, for example, the connector 14 can be made of metal, plastic, composite, or other material suitable for a particular application. For use in an exercise apparatus, metal can be a suitable material due to its relatively low cost and high strength.

The connector 14 can be made from a flat sheet of metal to create the flat metal blank 30. The flat metal blank 30 can be bent to create the connector 14.

Figure 4:
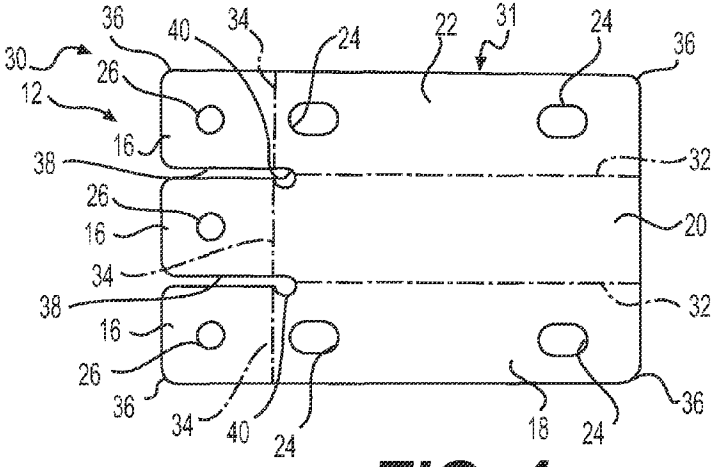
FIG. 4 is a top planar view of a stamped metal blank prior to being formed into the connector or anchor, as shown in FIGS. 1 and 8.
Figure 5:
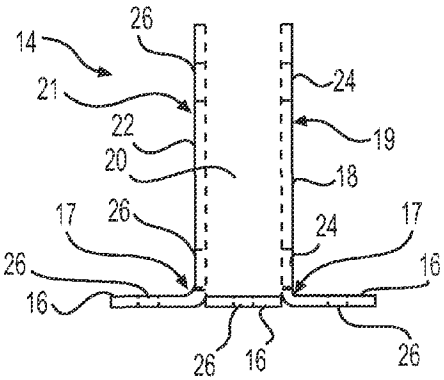
FIG. 5 is a front elevational view of the connector or anchor after being formed into a connector or anchor, as shown in FIGS. 1 and 8.
Figure 7:
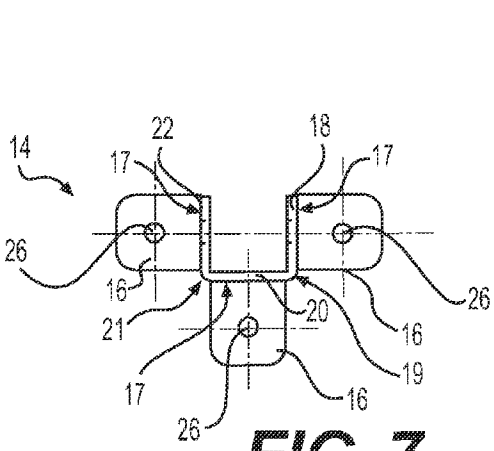
FIG. 7 is a top planar view of the connector or anchor, as shown in FIG. 8.
Figure 8:
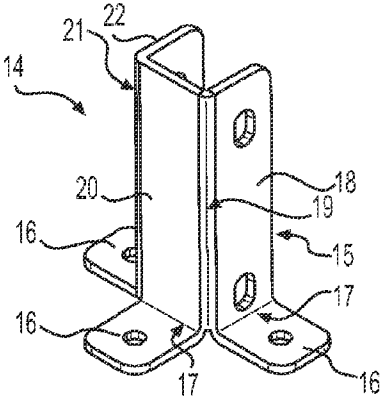
FIG. 8 is a perspective view of the resulting connector made from the plate shown in FIG. 4.
Figure 6:
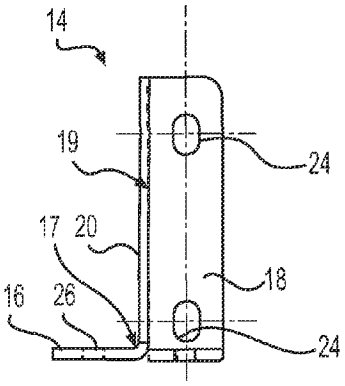
FIG. 6 is a side elevational view of the connector or anchor, as shown in FIG. 8.

As shown in FIG. 4, the flat metal blank 30 will be bent along the bending lines 32, 32 to create or form the three side panels 18, 20, 22 defining the three sided channel 15 of the connector 14 shown in FIG. 8. The three side panels 18, 20, 22 are contiguous with each other, and share a continuous wall with each other, since the connector 14 is created or formed by bending the single flat metal blank 30. Thus, the three side panels 18, 20, 22 are joined together by the integral bent connections 19, 21, as shown in FIG. 7.

The step or steps of bending the flat metal blank 30 into the three sided channel 15 results in an integral high strength connection between the respective side panels 18, 20, 22 providing a high strength connector 14 suitable for use in assembling or anchoring exercise apparatus. In this arrangement, due to the bending step, the respective side panels 18, 20, 22 are also connected along their entire lengths and the length of the three sided channel 15, again increasing the integrity and high strength of the resulting connector 14.

The flanges 16, 16, 16 As also shown in FIG. 4, the flat metal blank 30 will be bent along the bending lines 34, 34, 34 to create or form the three flanges 16, 16, 16 extending outwardly from the three sided channel 15 of the connector 14 shown in FIG. 8. The three flanges 16, 16, 16 are contiguous and continuous with a main portion 31 of the flat metal blank 30, since the connector 14 is created or formed from the single flat metal blank 30.

The step or steps of bending the flanges 16, 16, 16 relative the main portion 31 of the flat metal blank 30 results in integral high strength connections between the respective flanges 16, 16, 16 and main portion 31 of the flat metal blank 30 also enhancing the high strength of the high strength connector 14 suitable for use in assembling or anchoring exercise apparatus. In this arrangement, due to the bending step, the respective side panels 18, 20, 22 are also connected along their entire widths to the main portion 31 of the flat metal blank 30, again increasing the integrity and high strength of the resulting connector 14.

The integral bent connections 19, 21 between the side panels 18, 20, 22 of the three sided channel 15 and the integral bent connections 17 between the side panels 18, 20, 22 and the flanges 16, 16, 16 all contribute to the integrity and high strength of the box-like construction of the connector 14. Specifically, the bent nature of the walls of the integral bent connections 17, 19, 21 allow stress to flow around the bent connections 17, 19, 21, and then to be dispersed into the side panels 18, 20, 22 enhancing the high strength, performance, and longevity of the connector 14 under heavy work loads for a long period of time.

The radius of the integral bent connectors 17, 19, 21 can be configured to enhance the high strength of the connector 14. For example, the radius can be increased to enhance the flow of stress from the bent connectors to the side panels 18, 20, 22 and prevent stress risers. Further, the shape of the bent connectors 17, 19, 21 can be modified by changing the cross-sectional wall shape at the bend, again to customize stress flow for various purposes (e.g. integral bent connectors are made stronger at base of connector 15 to provide enhanced flexibility of members 12 to prevent cracking or wear). Thus, the thickness of the walls of the connector 14 can be varied and customized accordingly.

Method of Making

A metal connector 14 can be made, for example, by one of the following methods:

1) Stamping a flat metal sheet to create a flat metal blank having a particular shape; and bending the flat metal blank to create the connector 14.
2) Cutting flat metal sheet (e.g. by machining, grinding, sawing, waterjetting, torching, industrial lasering, cutting, plasma cutting) to create a flat metal blank having a particular shape; and bending the flat metal blank to create the connector 14.
3) Making metal components or parts of connector (e.g. three separate metal plates used to form the connector channel; and assembling (e.g. mechanically connecting and/or welding the three plates).

The steps in the above methods can occur simultaneously, or in a particular sequence. In addition to the above steps, the flat metal sheet or flat metal blank can, for example, be punched, cut, drilled, machined to provide connector (e.g. bolt, screw, anchor) holes. Further, the connector 14 can be hardened, coated (e.g. paint, powder coated), metal coated (e.g. chromed), treated (e.g. polished, beaded, surfaced, etched) to create a finished connector 14.

A method of making the connector 14 is illustrated in FIGS. 4-8

As shown in FIG. 4, a flat metal blank 30 (e.g. flat plate made of steel, aluminum, titanium) having the particular shape shown is created or provided. For example, the flat metal blank is stamped, cut, machined and/or welded.

The flat metal blank 30 is then bent along fold lines 32, 32. Further, the flanges 16, 16, 16, are bent along fold lines, 34, 34, 34, and outwardly relative to the side channel portions 18, 20, 22. The order of bending, for example, can be by first bending the metal blank 30 for form the side channel portions 18, 20, 22, and then the side channel portions 18, 20, 22 are bent outwardly, or the bending occurs in the opposite order. Alternatively, the bending can occur simultaneously by using a stamping press that bends and/or cuts the edges of the flat metal blank is a single step or multiple step process.

The through holes 24, 26 can be made (e.g. punched, cut, drilled, machined) in the connector 14 before, after, or simultaneously with other connector forming or creating operations.

The flat metal plate blank 30 is formed or created to have the particular shape shown in FIG. 4, for example, by stamping, cutting, machining, milling, electro discharge machining, water jet cutting, laser cutting, or other suitable shaping method. The resulting flat metal plate blank 30 can included rounded edges 36 and slots 38 dividing the flat metal plate blank 30 into the three flanges 16, 16, 16. The slots 38 have rounded holes 40, 40 to eliminate a stress riser and prevent tearing (i.e. by reducing shearing forces).

The flat metal blank 30 can be bent into the connector 30 by using a metal brake or by stamping.

We claim:

1. An exercise equipment connector for connecting an exercise equipment member, having at least one transverse through hole, to a support structure, the connector comprising:

a three sided channel having one open side and three closed side panels, the channel having a rectangular cross-section;

three connecting flanges each extending outwardly from each of the three closed side panels of the three sided channel, the connecting flanges being located at one end of the channel; and a connection arrangement for positively securing the exercise equipment member within the three sided channel of the connector, the connection arrangement is configured so that the at least one transverse through hole provided in the exercise equipment member aligns with at least one set of transverse and aligned through holes provided in parallel sides of the three sided channel of the connector when connected together, and a fastener configured to extend through aligned through holes of the exercise equipment member and connector and connect together the parallel sides of the three sided channel and the exercise equipment member to positively secure the exercise equipment member to the connector.

2. The exercise equipment connector according to claim 1, wherein the channel comprises a continuous wall.

3. The exercise equipment connector according to claim 1, wherein the side panels are connected together by integral bent connections.

4. The exercise equipment connector according to claim 3, wherein the integral bent connections are provided along an entire length of the side panels.

5. The exercise equipment connector according to claim 1, wherein the three side panels are defined by a continuous wall of the three sided channel.

6. The exercise equipment connector according to claim 1, wherein the connector comprises flanges each bent outwardly from the respective sides of the three sided panel.

7. The exercise equipment connector according to claim 6, wherein the flanges are perpendicular relative to each side of the three sided channel, the flanges extending outwardly from each side of each side panel.

8. The exercise equipment connector according to claim 7, wherein the flanges a width equal to a width of each side panel.

9. The exercise equipment connector according to claim 6, wherein two opposed side panels of the three sided channel are provided with at least one through hole and a fastener to connect the post or beam of the exercise equipment installed in the connector to secure the post or beam to the connector.

10. The exercise equipment connector according to claim 9, wherein the flanges are each provided with at least one through hole to allow a connecting or anchoring fastener to connect or anchor the flanges to the another support structure such as a floor, wall, ceiling, exercise equipment, or other support.

11. The exercise equipment connector according to claim 1, wherein the connector is made by bending a flat metal plate.

12. The exercise equipment connector according to claim 1, wherein the connector is made by bending a flat metal blank.

13. An exercise apparatus comprising the exercise equipment connector according to claim 1.

14. An exercise apparatus comprising a member and an exercise equipment connector according to claim 1.

15. The connector according to claim 1, further comprising a bolt fastener configured to be accommodated within aligned through holes in the exercise equipment member and the connector.

16. The connector according to claim 15, wherein the fastener is a bolt and nut.

17. The connector according to claim 1, wherein the three sided channel comprises slots separating adjacent connecting flanges, the slots ending with rounded holes in a flat blank of the connector prior to being bent into a bent configuration of the connector.

18. The connector according to claim 1, wherein the through holes provided in the parallel sides of the three sided channel are elongated-shaped.

19. An exercise equipment connector for connecting an exercise equipment member, having one or more transverse through holes, to a support structure, the connector comprising:

a three sided channel having a continuous wall and a rectangular cross-section, the three sided channel having one open side and three contiguous side panels defined by the continuous wall of the three sided channel, the three side panels joined together along an entire length of the side panels by integral bent wall connections;

three connecting flanges each extending outwardly from each of the three side panels of the three sided channel, the connecting flanges being located at one end of the channel, the connecting flanges defined by the continuous wall of the three sided channel, the flanges being joined together along an entire width of each of the flanges by integral bent wall connections; and a connecting arrangement for positively securing the exercise equipment member to the connector, the connecting arrangement is configured so that the one or more transverse through holes provided in opposing parallel side panels of the three sided channel are aligned, the three sided channel being configured so that the transverse and aligned through holes of the three sided channel align with the one or more transverse through holes in the exercise equipment member when connected together, and a fastener configured to be inserted through the aligned through holes in the connector and one or more through holes in the exercise equipment member and connect together the opposed parallel sides of the three sided connector and the exercise equipment member to positively secure the exercise equipment member to the connector.

20. An exercise apparatus comprising the exercise equipment connector according to claim 19.

21. An exercise apparatus comprising a member and an exercise equipment connector according to claim 19.

22. The connector according to claim 19, further comprising a bolt fastener configured to be accommodated within aligned through holes in the exercise equipment member and the connector.

23. The connector according to claim 22, wherein the fastener is a bolt and nut.

24. The connector according to claim 19, wherein the three sided channel comprises slots separating adjacent connecting flanges, the slots ending with rounded holes in a flat blank of the connector prior to being bent into a bent configuration of the connector.

25. The connector according to claim 19, wherein the through holes provided in the parallel sides of the three sided channel are elongated-shaped.

26. A method of making a connector for an exercised equipment member, having a transverse through hole in a side of the exercise equipment member, of an exercise apparatus, comprising:

providing a flat metal blank;

bending the flat metal blank into a three sided channel having a rectangular cross-section;

bending the flat metal blank to provide three flanges each extending outwardly from one side of the three sided channel at one end of the channel;

providing through holes in the connector so that the through holes are or become transverse and aligned through holes in opposed parallel sides of the three sided channel;

aligning the through holes in the connector with the through hole in the exercise equipment member; and inserting a fastener through the aligned through holes in the connector and through hole in the exercise equipment member to connect the opposed parallel side of the three side channel and exercise equipment member together.

27. The method according to claim 26, further comprising bending the flat metal blank along two spaced apart folding lines to form the three sided channel.

28. The method according to claim 27, further comprising bending the plate along three aligned folding lines to provide an outwardly extending flange on each side of the three sided channel.

29. The method according to claim 26, further comprising:

placing at least a portion of the post or beam of the exercise device in the three sided channel of the connector;

aligning the transverse through hole of the post or beam of the exercise device with the transverse and aligned through holes of the three sided connector; and fastening a fastener through the aligned through holes in the post or beam and connector to positively secure the post or beam of the exercise device within the connector.

30. An exercise equipment connector for connecting a post or beam of an exercise equipment to another support structure, the connector comprising:

a three sided channel having one open side and three closed side panels, the channel having a rectangular cross-section;

three flanges each extending outwardly from each of the three closed side panels of the three sided channel, the at least one connecting flange located at one end of the channel, the three sided channel having slots separating adjacent flanges, the slots ending with rounded holes in a flat blank of the connector prior to being bent into a bent configuration of the connector; and a connection arrangement for positively securing the post or beam of the exercise equipment within the three sided channel of the connector against movement or removal from the three sided channel, the connection arrangement comprising at least one transverse through hole provided in a side of the post or beam of the exercise device to be aligned with at least one set of transverse and aligned through holes provided in parallel sides of the three sided channel of the connector to accommodate a fastener to positively secure the post or beam to the connector.

* * * * *